US011194264B2

(12) United States Patent
Katayama et al.

(10) Patent No.: US 11,194,264 B2
(45) Date of Patent: Dec. 7, 2021

(54) OPTICAL SCANNING APPARATUS WITH OFFSET BEAM DETECT SENSOR FOR SCAN LINE POSITIONING IN SUB-SCAN DIRECTION AND IMAGE FORMING APPARATUS WITH OPTICAL SCANNING APPARATUS

(71) Applicant: CANON KABUSHIKI KAISHA, Tokyo (JP)

(72) Inventors: Hiroki Katayama, Suntou-gun (JP); Jun Nagatoshi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/828,060

(22) Filed: Mar. 24, 2020

(65) Prior Publication Data

US 2020/0310276 A1 Oct. 1, 2020

(30) Foreign Application Priority Data

Mar. 29, 2019 (JP) ..... JP2019-066221
Feb. 28, 2020 (JP) ..... JP2020-032975

(51) Int. Cl.
*G03G 15/04* (2006.01)
*G03G 15/043* (2006.01)

(52) U.S. Cl.
CPC ..... *G03G 15/04036* (2013.01); *G03G 15/043* (2013.01); *G03G 15/04072* (2013.01); *G03G 2215/0404* (2013.01)

(58) Field of Classification Search
CPC ..... G03G 15/04036; G03G 15/043; G03G 15/04072; G03G 2215/0404
See application file for complete search history.

(56) References Cited

U.S. PATENT DOCUMENTS 9,128,291 B2 9/2015 Nagatoshi et al. ..... G03G 21/1666
9,581,929 B2 2/2017 Nagatoshi et al. ..... G03G 21/1666
9,854,120 B2 12/2017 Tanaka et al. ..... H04N 1/00519
2015/0346484 A1* 12/2015 Suzuki ..... B41J 2/45 347/118

(Continued)

FOREIGN PATENT DOCUMENTS

JP 2008-257158 10/2008
JP 2010-000676 1/2010

(Continued)

*Primary Examiner* — Walter L Lindsay, Jr.
*Assistant Examiner* — Laura Roth
(74) *Attorney, Agent, or Firm* — Venable LLP

(57) ABSTRACT

An image forming apparatus for forming an image in accordance with image information on a sheet includes a photosensitive member; a scanner unit for scanning the member with a laser beam in accordance with the information, the scanner unit including a source for emitting the beam, a deflector having a polygonal mirror for reflecting the beam to deflect it, and a sensor for receiving the beam deflected by the deflector; a controller for controlling scanning start timing of the beam in response to an output of the sensor. A reference position of scanning lines of the beam in a sub-scan direction and a center position of a receipt surface of the sensor in the direction are deviated from each other. For all scanning lines by reflecting surfaces of the rotatable polygonal mirror, only parts, in the direction, of the scanning lines pass the receipt surface of the sensor.

9 Claims, 11 Drawing Sheets

(56) References Cited

U.S. PATENT DOCUMENTS

| | | | | |
|---|---|---|---|---|
| 2017/0153567 | A1 | 6/2017 | Yamaya | |
| 2020/0103784 | A1 | 4/2020 | Nagatoshi | G03G 15/2064 |
| 2020/0122483 | A1 | 4/2020 | Tanaka et al. | G02B 26/122 |

FOREIGN PATENT DOCUMENTS

| | | | |
|---|---|---|---|
| JP | 2017-102144 | | 6/2017 |
| JP | 2017227739 | A * | 12/2017 |

* cited by examiner

OPTICAL SCANNING APPARATUS WITH OFFSET BEAM DETECT SENSOR FOR SCAN LINE POSITIONING IN SUB-SCAN DIRECTION AND IMAGE FORMING APPARATUS WITH OPTICAL SCANNING APPARATUS

FIELD OF THE INVENTION AND RELATED ART

The present invention relates to an optical scanning apparatus such as a laser scanner mounted in an image forming apparatus such as an electrophotographic printer, an electrophotographic copying machine, and the like.

A laser scanner has a rotational polygonal mirror, which deflects a beam of laser light projected from a light source while being modulated with the information of an image to be formed. It sometimes occurs that the centerline of the reflective surfaces of the rotational polygonal mirror are tilted ("surface tilt") relative to the rotational axis of the deflecting device, because of the level of accuracy, at which the material for the rotational polygonal mirror is cut during the manufacture of the mirror, and also, the level of accuracy at which the rotational polygonal mirror is attached to the deflecting device. If the peripheral surface of a photosensitive drum is scanned by a beam of laser light deflected by the rotational polygonal mirror which is suffering from the "surface tilt", a phenomenon that the beam of laser light deflected by each of the deflective surfaces of the polygonal mirror misses its target point on the peripheral surface of the photosensitive drum, in terms of the secondary scanning direction (point on peripheral surface of photosensitive drum in terms of direction perpendicular to primary scanning direction) cyclically occurs. That is, because of "surface tilt", an optical scanning apparatus becomes nonuniform in scanning line interval. Consequently, an image forming apparatus outputs an image which is nonuniform in density (banding). That is, an image forming apparatus reduces in image quality.

Therefore, it is necessary to detect how much the actual line of scanning is offset from the target position. That is, it is necessary to detect the position of the actual line of scanning in terms of the secondary scanning direction. There is disclosed in Japanese Laid-open Patent Application No 2008-257158, a laser scanner having a diffractive optical element which deflects the beam of laser light into two beams of laser light which are different in direction, and two sensors which detect the two beams of laser light. The position of the scanning line in terms of the secondary scanning direction can be determined based on the difference in the length of time between the time at which one of the two beams of laser light passed through one of the sensors, and the time at which the other beam of laser light passed through the other sensor.

There is disclosed in Japanese Laid-open Patent Application No. 2017-102144 that one of the multiple reflective surfaces of the polygonal mirror of the optical scanner is chosen as a referential surface, based on the signals obtained through the detection of the beam of laser light deflected by the multiple reflective surfaces. In this case, the optical scanning apparatus is electrically adjusted in the position of its scanning line.

However, in the case of Japanese Laid-open Patent Application No. 2008-257158, such components as a diffractive optical element, multiple sensors, etc., for detecting the position of the actual secondary scanning line in terms of the secondary scanning direction, are required. Therefore, it suffers from the problem that it has to be increased in overall size. Further, in the case of Japanese Laid-open Patent Application No. 2017-102144, a slit which is placed in front of the BD sensor is required. Thus, it suffers from the problem that it increases an optical scanner in component count.

The present invention is for solving the problems described above. Thus, its primary object is to provide an optical scanning apparatus which is simple in structure, and yet, can accurately detect the position of its beam of laser light in terms of the secondary scanning direction, and an image forming apparatus having such an optical scanning apparatus.

SUMMARY OF THE INVENTION

According to an aspect of the present invention, there is provided an image forming apparatus for forming an image in accordance with image information on a recording material, said apparatus comprising a photosensitive member; a scanner unit configured to scan said photosensitive member with a laser beam in accordance with the image information, said scanner unit including a light source configured to emit the laser beam, a deflector having a rotatable polygonal mirror configured to reflect the laser beam to deflect the laser beam, and a sensor configured to receive the laser beam deflected by said deflector; a controller configured to control scanning start timing of the laser beam in response to an output of said sensor, wherein a reference position of scanning lines of the laser beam in a sub-scan direction and a center position of a receipt surface of said sensor in the sub-scan direction are deviated from each other, and wherein for all of the scanning lines by reflecting surfaces of said rotatable polygonal mirror, only parts, in the sub-scan direction, of the scanning lines pass said receipt surface of said sensor.

Further features of the present invention will become apparent from the following description of exemplary embodiments with reference to the attached drawings.

Figure 7:
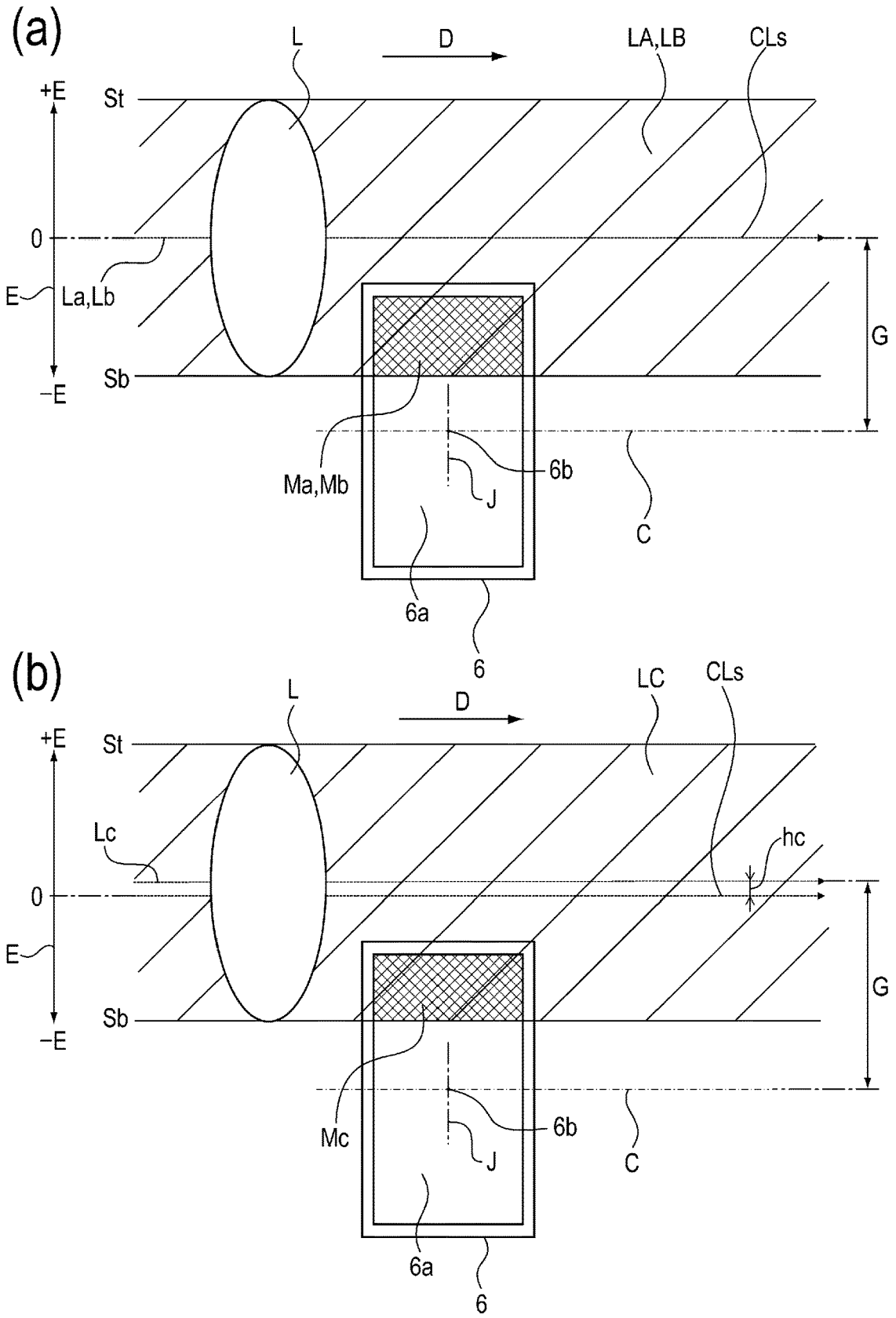

Parts (a) and (b) of FIG. 7 are drawings for describing the positional relationship between the paths of the beam of laser light deflected by the reflective surfaces of the polygon mirror, and BD sensor.

Figure 8:
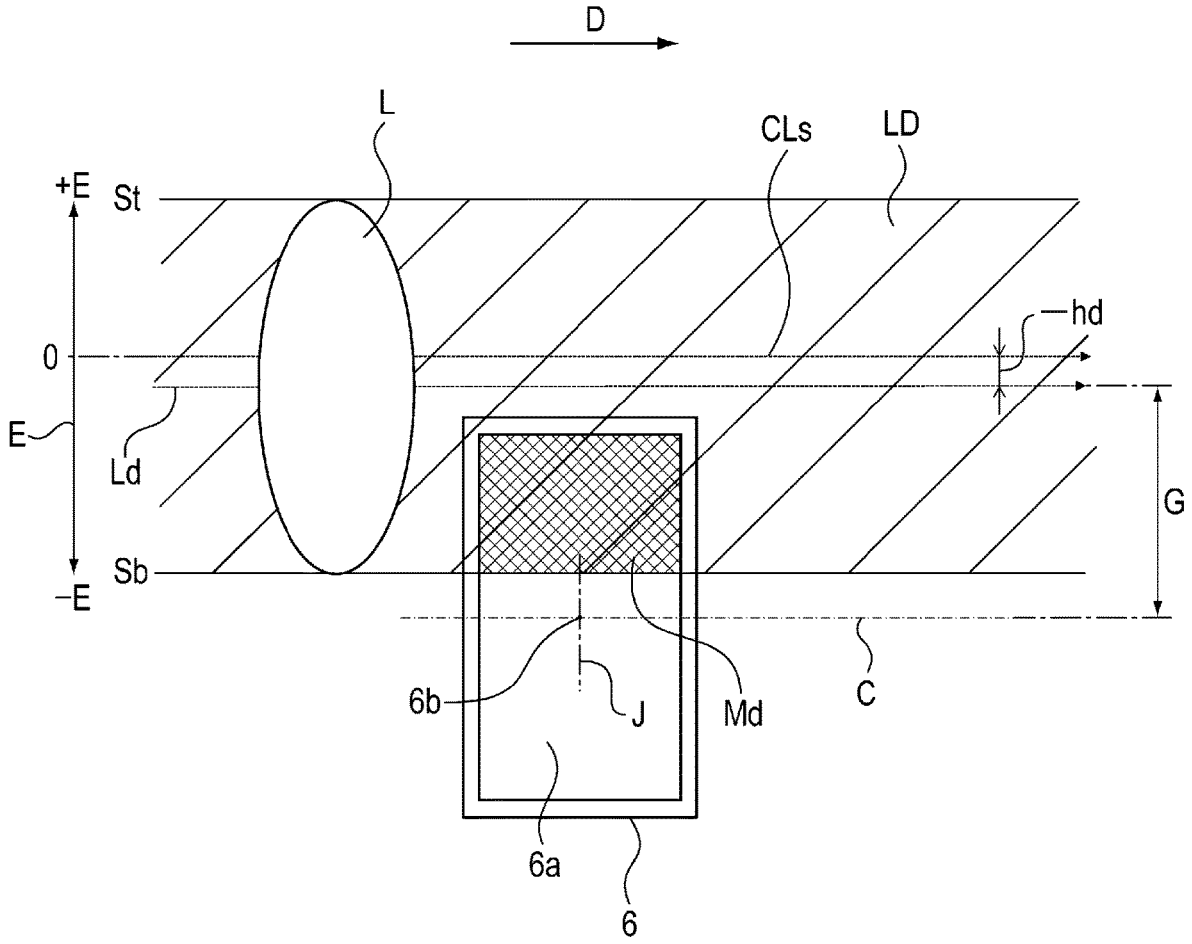

FIG. 8 is a drawing for describing the positional relationship between the paths of the beam of laser light reflected by the reflective surfaces of the polygonal mirror, and BD sensor.

Figure 9:
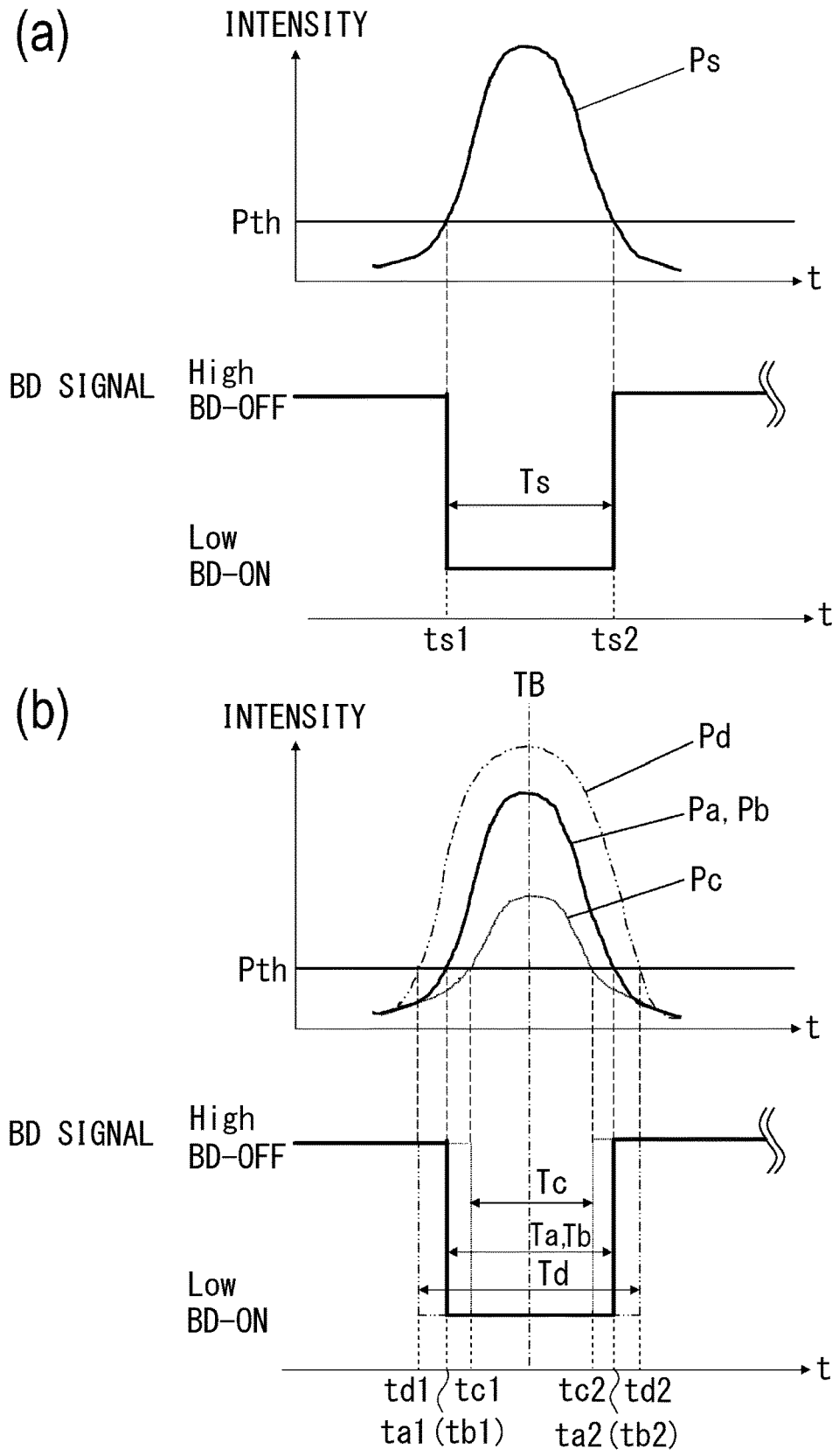

Parts (a) and (b) of FIG. 9 are drawings for describing the amount of light received by the BD sensor, and magnitude of the output of the BD sensor.

Figure 10:
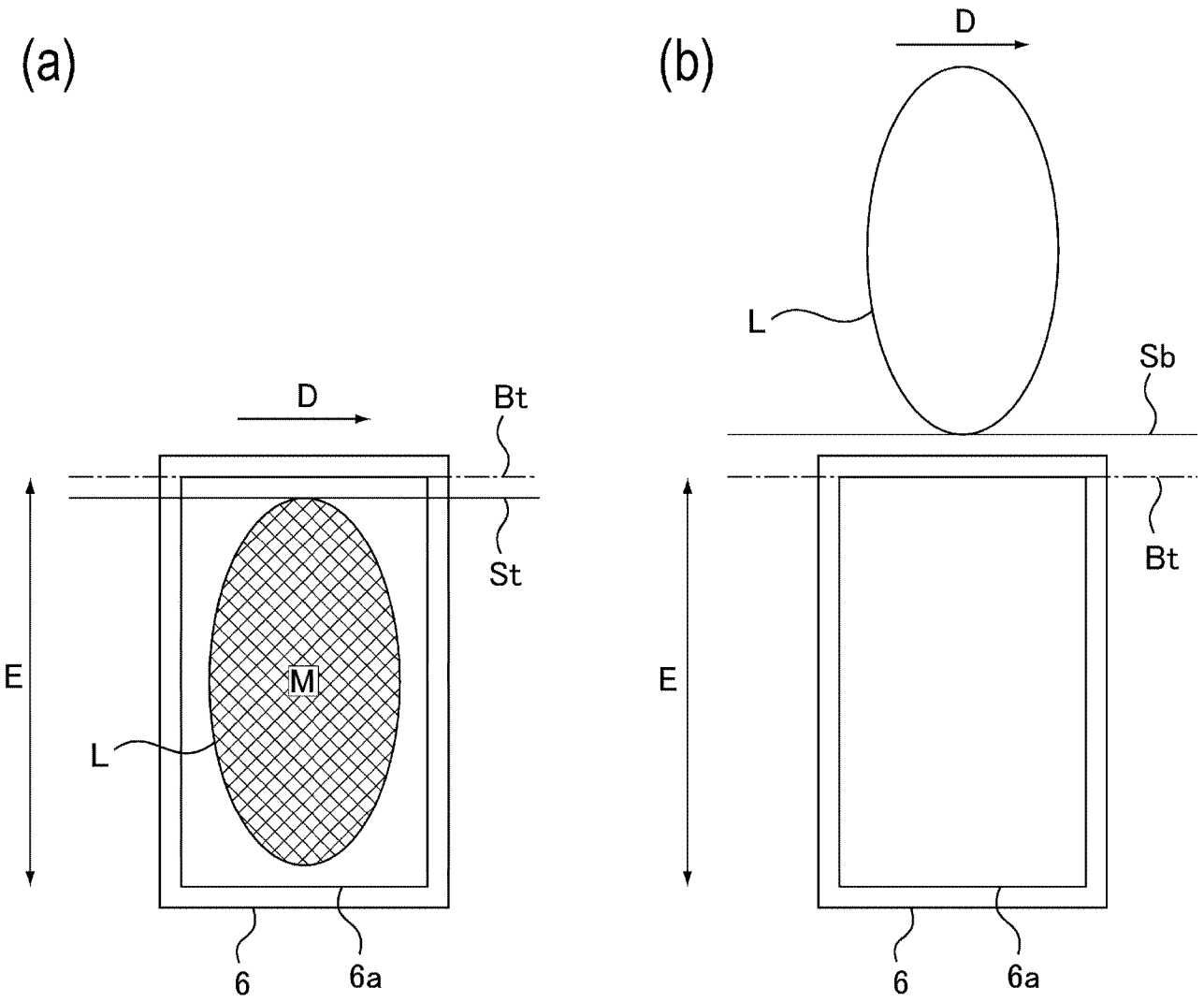

Part (a) of FIG. 10 is a drawing which shows the relationship between the beam L of laser light and light reception surface 6*a* of the BD sensor 6 when the entirety of the beam of laser light passes through the light reception surface of the BD sensor. Part (b) of FIG. 10 is a drawing which shows the positional relationship between the beam L of laser light and the light reception surface 6*a* of the BD sensor 6 when the entirety of the beam of laser light passes outside the light reception surface of the BD sensor.

Figure 11:
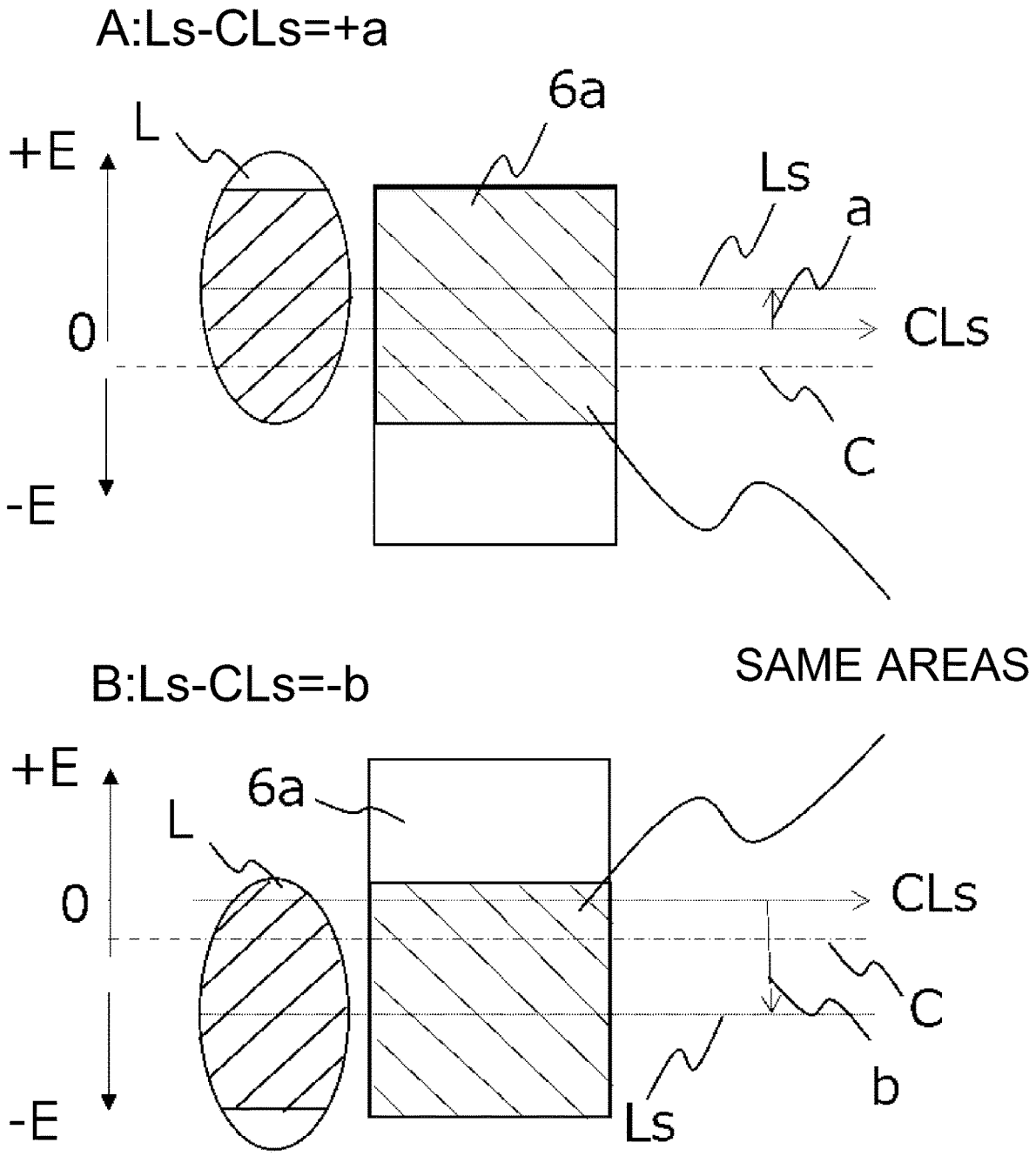

FIG. 11 is a drawing for describing two cases which are different in the position of the path of the beam L of laser light, but, are the same in the size of the light reception area of the light reception surface 6*a* of the BD sensor 6.

DESCRIPTION OF THE EMBODIMENTS

Hereinafter, the present invention is concretely described with reference to one of the image forming apparatuses having an optical scanning apparatus which is in accordance with the present invention.

<Image Forming Apparatus>

Figure 1:
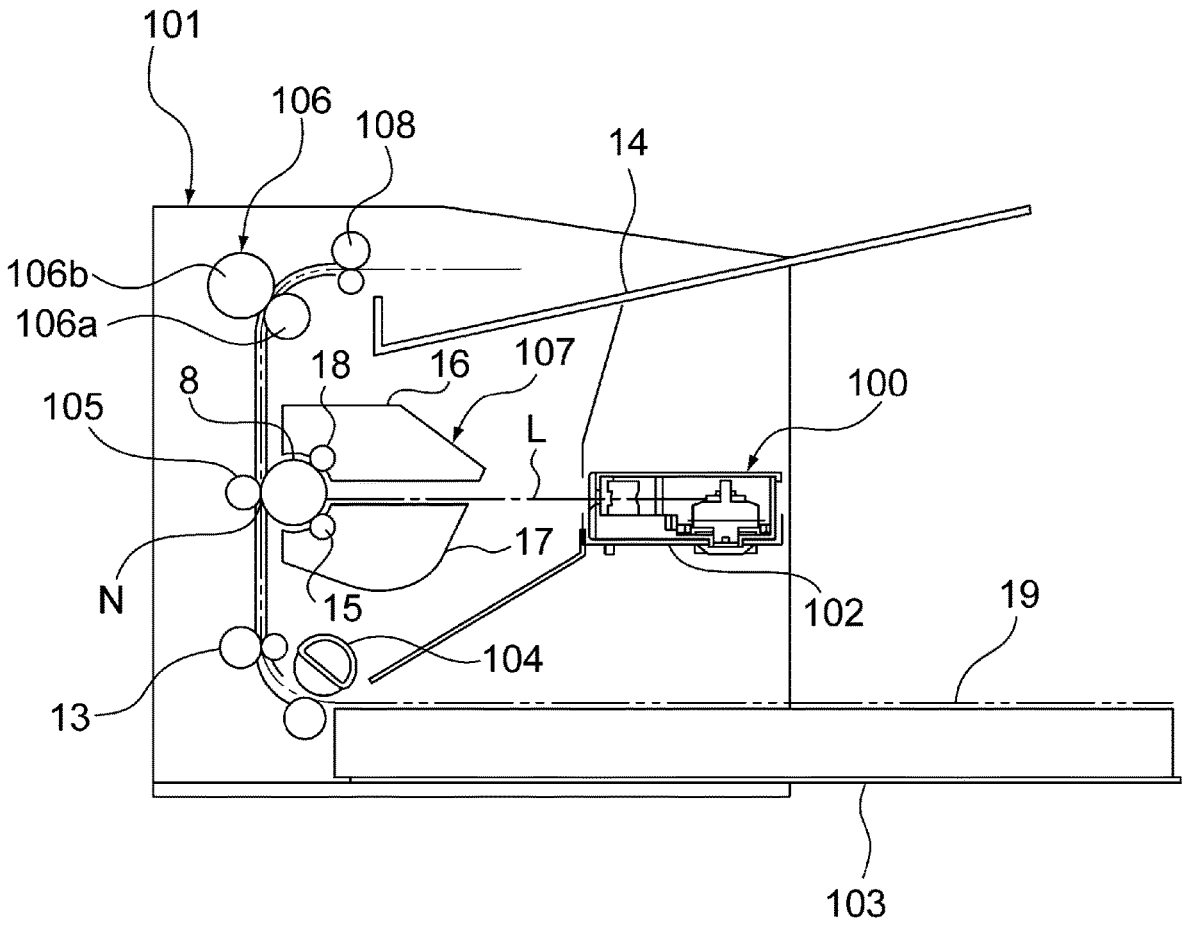
FIG. 1 is a sectional view of an image forming apparatus having an optical scanning apparatus; it shows the structure of the apparatus.

To begin with, the image forming apparatus 101 is described about its structure with reference to FIG. 1. FIG. 1 is a sectional view of the image forming apparatus 101 equipped with an optical scanning apparatus 100. It shows the structure of the image forming apparatus 101. The image forming apparatus 101 shown in FIG. 1 is an example of electrophotographic laser beam printer. The image forming apparatus 101 forms an image on a sheet 19 of recording medium such as paper. It is equipped with a process cartridge 107 as an image forming portion.

The process cartridge 107 is provided with a cleaning unit 16 and a development unit 17. The cleaning unit 16 is provided with a photosensitive drum 8, as an image bearing member, which is rotatable in the clockwise direction. As the photosensitive drum 8 is rotates in the clockwise direction in FIG. 1, its peripheral surface is uniformly charged by a charge roller 18, as a charging means, with which the cleaning unit 16 is provided.

The image forming apparatus 101 is provided with an optical plate 102, which is a part of the casing of the image forming apparatus 101. The optical plate 102 is where the optical scanning apparatus 100 is attached. Upon the uniformly charged portion of the peripheral surface of the photosensitive drum 8, a beam L of laser light is projected from the optical scanning apparatus 100 while being modulated with the information of the image to be formed. As a result, an electrostatic latent image is formed on the peripheral surface of the photosensitive drum 8. Then, the electrostatic latent image formed on the peripheral surface of the photosensitive drum 8 is supplied with toner as developer, by a development roller 15 as a developer bearing member. Consequently, the electrostatic latent image is developed into a visible image, that is, an image formed of toner. Hereafter, this image formed of toner will be referred to as a toner image.

The bottom portion of the image forming apparatus 101 is provided with a feeding unit 103, in which sheets 19 of recording medium such as cardstock, ordinary paper, and the like are stored, and from which the sheets 19 are fed one by one into the main assembly of the image forming apparatus 101 while being separated from the rest. As a sheet 19 of recording medium is fed into the main assembly of the image forming apparatus 101, it is sent to the nip portion of a pair of registration rollers 13 while the rollers 13 are kept stationary. As the leading edge of the sheet 19 is made to collide with the nip portion, it is corrected in attitude, if the sheet 19 happens to be being conveyed askew.

The image forming apparatus 101 is provided with a transfer roller 105, as a transferring means, which is positioned so that its peripheral surface opposes the peripheral surface of the photosensitive drum 8. The sheet 19 is conveyed to the transfer nip N formed between the photosensitive drum 8 and transfer roller 105, by the pair of registration rollers 13, remaining sandwiched by the pair of registration rollers 13, with such timing that the sheet 19 arrives at the transfer nip N in synchronism with the arrival of the leading edges of the toner image formed on the peripheral surface of the photosensitive drum 8 at the transfer nip N.

To the transfer roller 105, transfer bias is applied from an unshown transfer bias power source. As the transfer bias is applied, the toner image on the peripheral surface of the photosensitive drum 8 is transferred onto the sheet 19. Transfer residual toner, or the toner remaining on the peripheral surface of the photosensitive drum 8 after the transfer, is scraped away by an unshown cleaning means with which the cleaning unit 16 is provided.

After the transfer of the toner image onto the sheet 19 of recording medium in the transfer nip N, the sheet 19 is conveyed to a fixing apparatus 106 as a fixing means. The fixing apparatus 106 is provided with a heat roller 106*a* and a pressure roller 106*b*. While the sheet 19 which is bearing the toner image is conveyed between the heat roller 106*a* and pressure roller 106*b* while remaining pinched between the heat roller 106*a* and pressure roller 106*b*, the sheet 19 and toner image thereon are heated and pressed. Consequently, the toner image is thermally fixed to the sheet 19. Thereafter, the sheet 19 is conveyed further by a pair of discharged rollers 108 while remaining pinched by the pair of roller 108, and then, is discharged into a delivery tray 14.

<Optical Scanning Apparatus>

Figure 2:
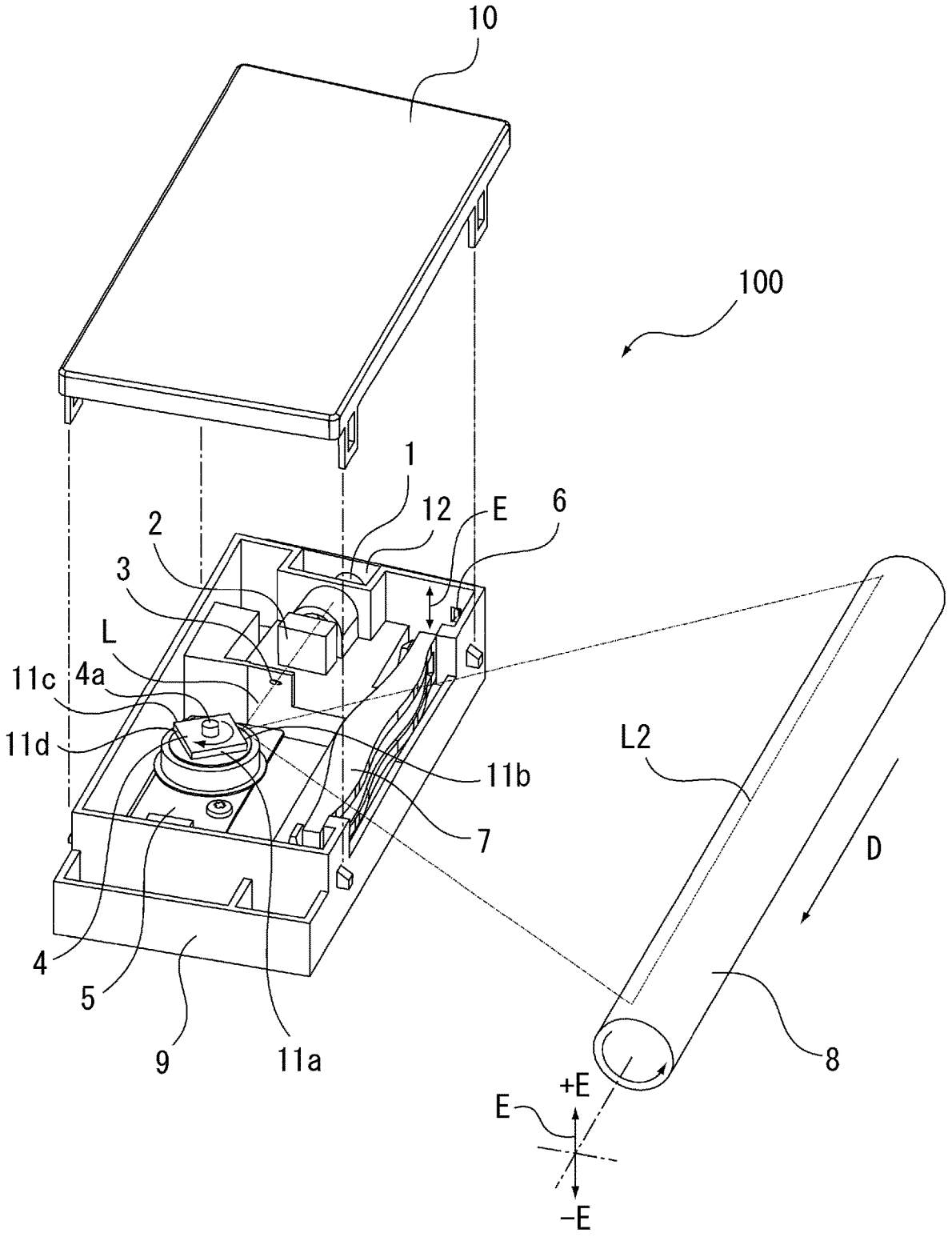
FIG. 2 is a perspective view of the optical scanning apparatus shown in FIG. 1.

Next, referring to FIG. 2, the optical scanning apparatus 100 is described about its structure, with reference to FIG. 2. FIG. 2 is a perspective view of the optical scanning apparatus 100. It shows the structure of the optical scanning apparatus 100. Referring to FIG. 2, a referential code 1 stands for a semiconductor laser, as a light source, which emits a beam L of laser light. A referential code 12 stands for a substrate (supporting member) which supports the semiconductor laser 1. A referential code 2 stands for an anamorphic lens which is an integral combination of a collimator lens and a cylindrical lens. A collimator lens turns a beam L of laser light into a beam of parallel light. A cylindrical lens focus the beam L of laser light only in the direction indicated by an arrow mark E in FIG. 2.

A referential code 3 stands for a diaphragm. A referential code 5 stands for a deflecting device. A referential code 4 stands for a polygon mirror, as a rotational multi-surface mirror, with which the deflecting device 5 is provided. Referential codes 11*a*-11*d* stand for multiple reflective surfaces of the polygon mirror 4, one for one. A referential code 6 stands for a BD sensor (beam detection sensor). The BD sensor 6, which is a detecting portion, detects the beam L of laser light reflected by the multiple reflective surfaces 11*a*-11*d*. It outputs signals for controlling the optical scanning apparatus 100 in the position on the peripheral surface of the photosensitive drum 8, at which an electrostatic latent image begins to be written in the direction indicated by an arrow mark D in FIG. 2 (direction parallel to rotational axis of photosensitive drum 8).

A referential code 7 stands for an fθ lens as a scanning lens. The fθ lens 7 has such a characteristic (fθ characteristic) that as the beam L of laser light enters it at an angle θ, it forms a spot, the size of which equals the product of f (focal length) and θ. A referential code 9 stands for an optical box, in which various optical members are held. A referential code 10 stands for a lid attached to the optical box 9 from the standpoint of preventing dust or the like from entering the optical box 9. Referring to FIG. 2, the direction (primary scanning direction) in which the beam L of laser light moves as the polygon mirror 4 is rotated in the direction indicated by the arrow mark D in FIG. 2. Further, a direction which is perpendicular to the direction indicated by the arrow mark D in FIG. 2, on the peripheral surface of the photosensitive drum 8 and the light reception surface 6*a* is the secondary scanning direction.

Regarding the above described structure of the optical scanning apparatus 100, as the beam L of laser light is emitted from the semiconductor laser 1, as a light source, while being modulated with the information of an image to be formed, it is turned by the anamorphic lens 2, into a beam of roughly parallel or convergent light in terms of the direction indicated by the arrow mark D in FIG. 2. Then, the beam L of laser light is put through the diaphragm 3, being thereby controlled in width, and forms a linear image which has a preset width in terms of the primary scan direction, on each of the reflective surfaces 11*a*-11*d* of the polygon mirror 4.

The deflecting device 5 rotates the polygon mirror 4 in the clockwise direction indicated in FIG. 2, about the rotational axis 4*a*. The polygon mirror 4 reflects the beam L of laser light emitted from the semiconductor laser 1, with its multiple reflective surfaces 11*a*-11*d*. As the polygon mirror 4 is rotated in the clockwise direction in FIG. 2, the beam L of laser light focused on each of the reflective surfaces 11*a*-11*d* is deflected by each of the reflective surfaces 11*a*-11*d* in a manner to linearly scan the peripheral surface of the photosensitive drum 8.

As the beam L of laser light is reflected by each of the reflective surfaces 11*a*-11*d*, it enters the BD sensor through the light reception surface 6*a* of the BD sensor, enters the fθ lens 7, and moves on the peripheral surface of the photosensitive drum 8 in the direction indicated by the arrow mark D in FIG. 2. A CPU 20, which will be described later (FIG. 3), controls the image forming apparatus 101 in the timing with which the image forming apparatus 101 begins to write an image (latent image) on the peripheral surface of the photosensitive drum 8, based on the BD signals outputted from the BD sensor 6. The BD signals outputted from the BD sensor 6 are detected for each of the reflective surfaces 11*a*-11*d*.

The fθ lens 7 is designed so that as the beam L of laser light enters the fθ lens 7, the fθ lens 7 focuses the beam L of laser light in such a manner that the beam L of laser light forms a spot on the peripheral surface of the photosensitive drum 8, and also, that the speed with which the spot moves on the peripheral surface of the photosensitive drum 8 remains constant. In order to provide the fθ lens 7 with the characteristic described above, the fθ lens 7 is given an aspherical shape. A referential code L2 stands for the direction in which the beam L of laser light moves on (scans) the peripheral surface of the photosensitive drum 8.

Then, through the process described above, an electrostatic latent image is formed on the peripheral surface of the photosensitive drum 8.

<Positional Relationship Between Scanning Line and BD Sensor>

Figure 4:
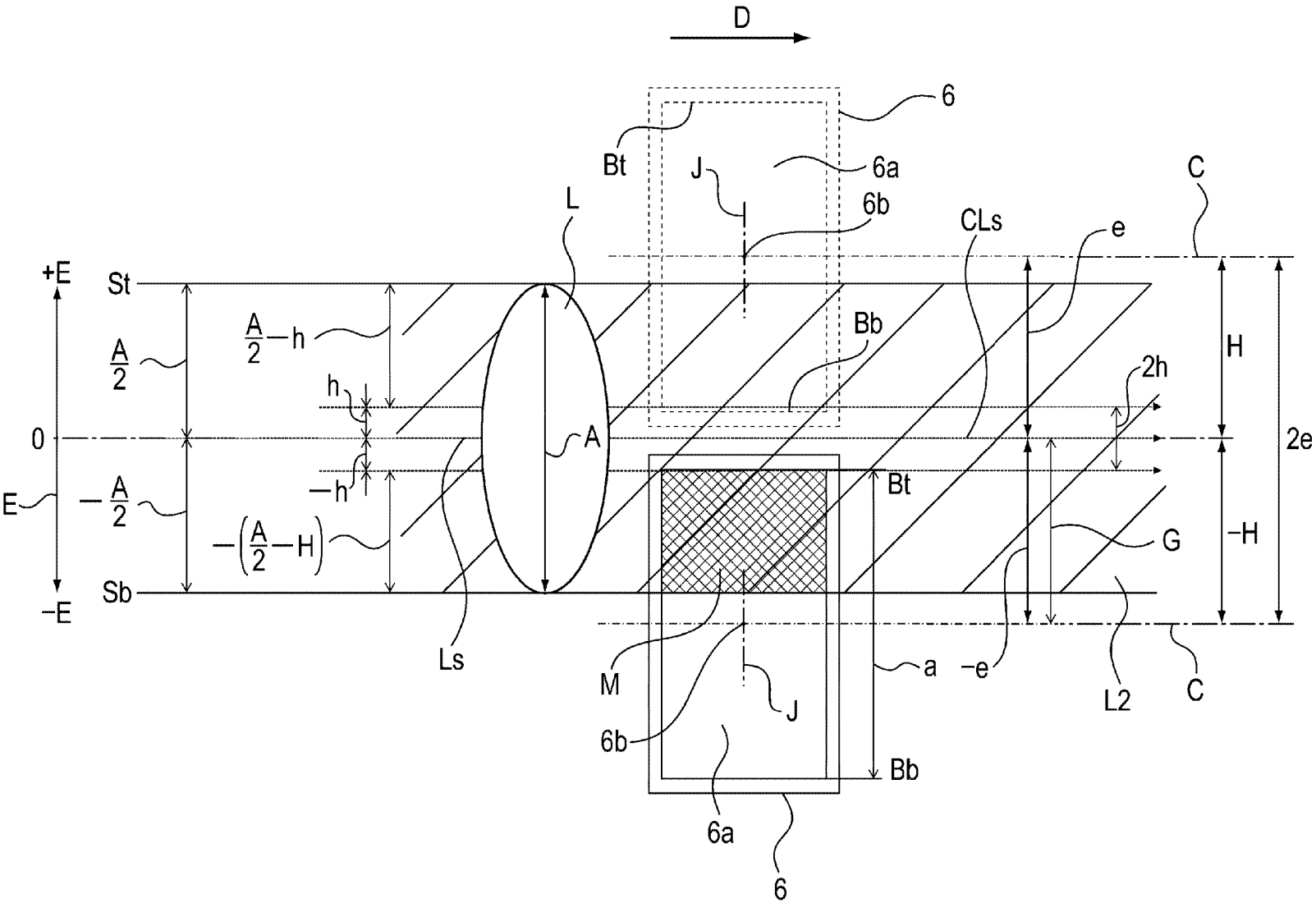
FIG. 4 is a drawing for describing the positional relationship between the scanning line and BD sensor.
Figure 5:
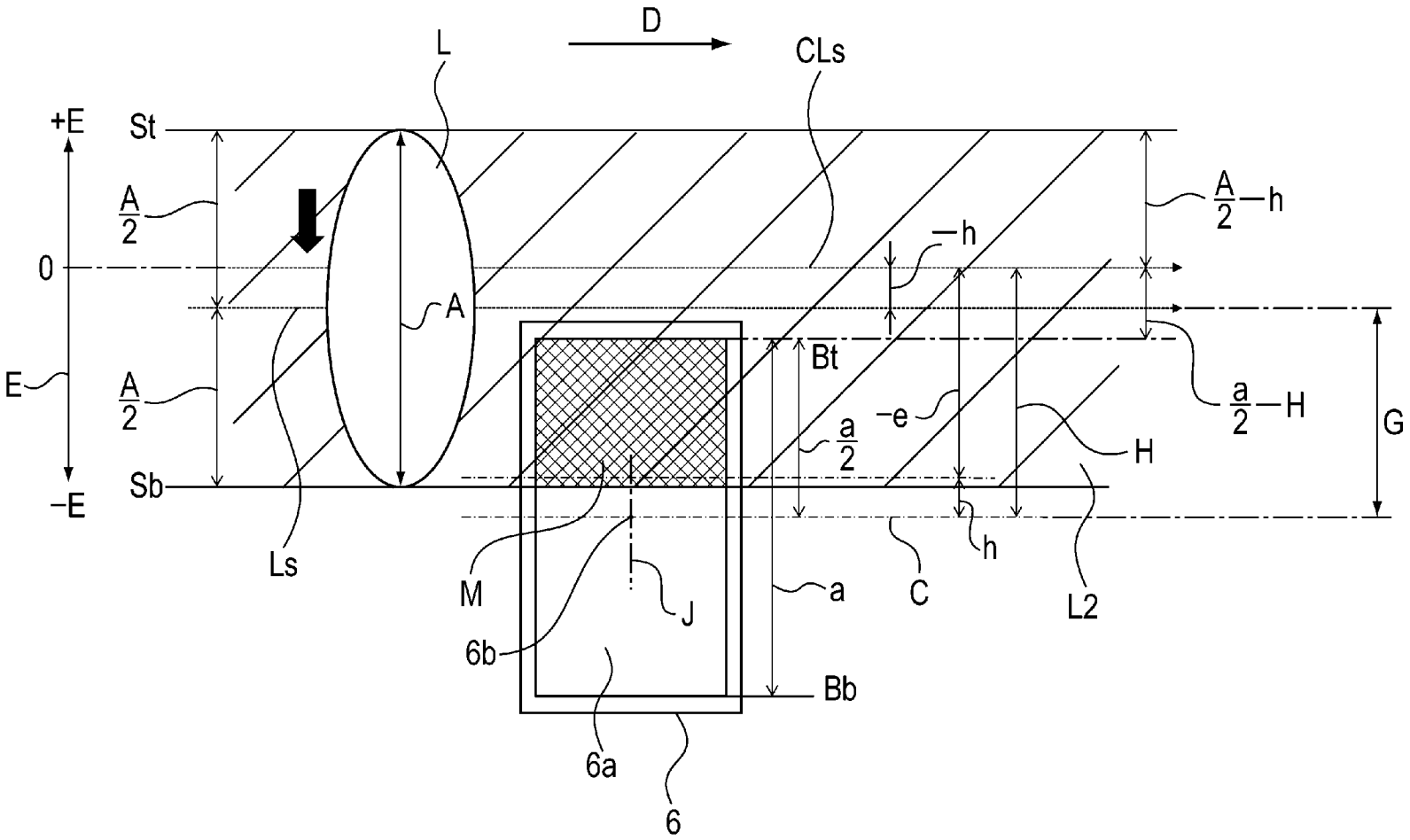
FIG. 5 is a drawing for describing the positional relationship between the scanning line and BD sensor.
Figure 6:
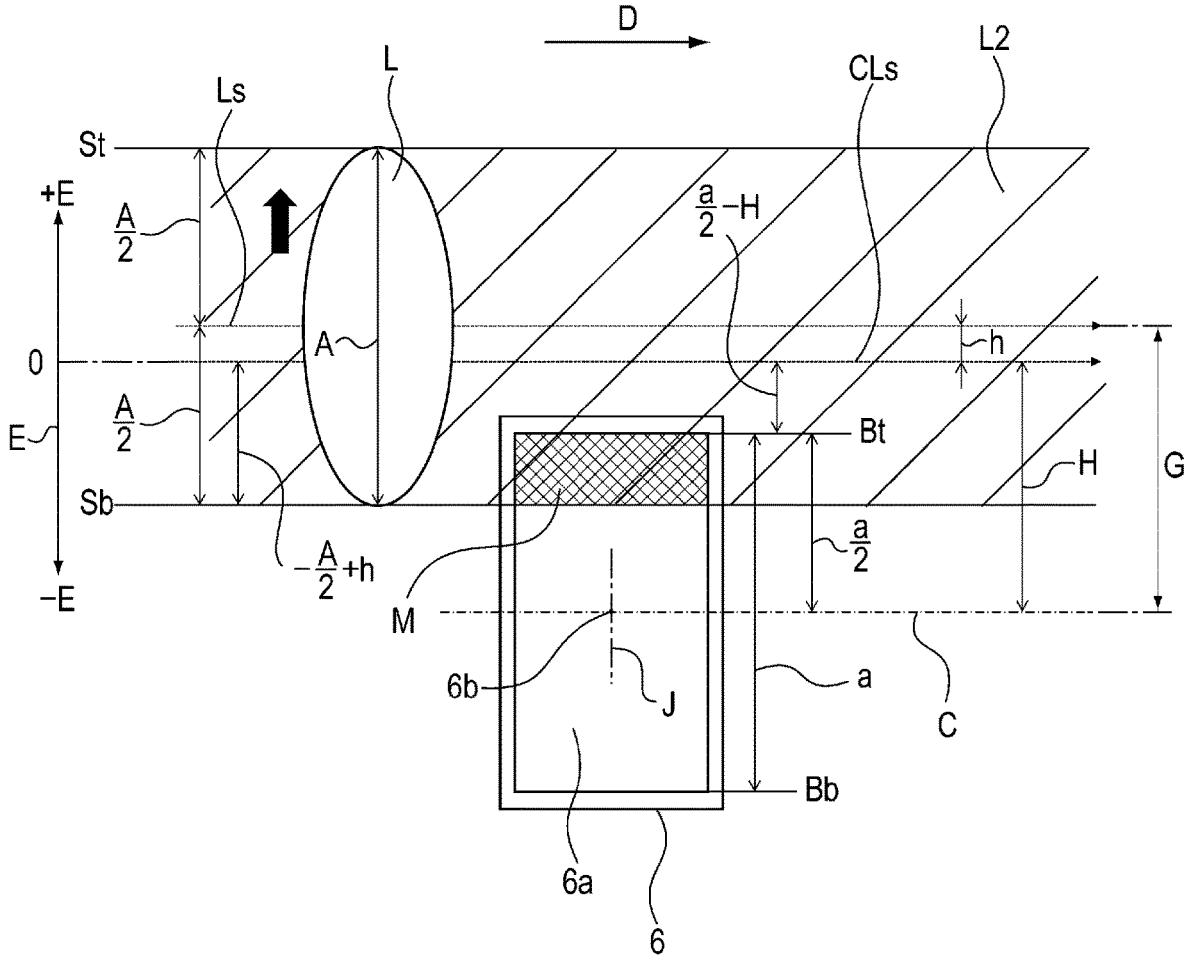
FIG. 6 is a drawing for describing the positional relationship between the scanning line and BD sensor.

Next, referring to FIGS. 4-6, the relationship between the scanning line L2 and BD sensor, of the optical scanning apparatus 100 in this embodiment is described. FIG. 4 represents a case in which the centerline Ls of the scanning line L2 in terms of the direction indicated by an arrow mark E coincides with the designed (preset) referential line CLs for the position for the scanning line L2. FIG. 5 represents a case where the centerline Ls of the scanning line L2 is offset in the direction indicated by an arrow mark −E by a width H. FIG. 6 represents a case where the centerline Ls of the scanning line L2 is offset in the direction indicated by an arrow mark +E by an width H due to the "surface tilt" of the polygon mirror 4. The optical scanning apparatus 100 has a function of determining whether the scanning line L2 which is attributable to each of the reflective surfaces 11*a*-11*d* is offset from the referential line CLs in the +E direction or −E direction, and also, the amount of offset based on the output of the BD sensor. Therefore, the positional relationship between the scanning line L2 and BD sensor 6, of the optical scanning apparatus 100, in terms of the secondary scanning direction, satisfies the following conditions.

(1) In terms of the secondary scanning direction, the referential line CLs for the scanning line L2 is offset from the centerline C which coincides with the center 6*b* of the light reception surface 6*a*.

(2) The positional relationship between the scanning lines L2 which correspond to reflective surfaces 11*a*-11*d*, respectively, and the centerline C of the light reception surface 6*a* is set so that even if the scanning line L2 offsets from the referential line CLs in the secondary scanning direction, due to the effect of the "surface tilt", or the like, the centerline Ls of the scanning line L2 will be on the same side as the side on which the referential line CLs is relative to the centerline C of the BD sensor.

(3) The optical scanning apparatus 100 is set so that the scanning lines L2 which correspond to reflective surfaces 11*a*-11*d*, one for one, only partially pass through the light reception surface 6*a* of the BD sensor 6.

Next, the positional relationship between the scanning line L2 of the optical scanning apparatus 100, and BD sensor 6 is concretely described.

As will be understood with reference to FIGS. 4-6, the optical scanning apparatus 100 is structured so that in terms of the secondary scanning direction (indicated by arrow mark E), referential line CLs for the scanning line L2, centerline C of the light reception surface 6*a* is offset from each other. Further, the positional relationship between the BD sensor 6 and scanning line L2 in terms of the arrow mark E direction is set so that the beam L of laser light only partially passes through the light reception surface 6*a* of the BD sensor 6.

On the other hand, part (a) of FIGS. 10 and 10(*b*) represent an example of comparative optical scanning apparatus. Part (a) of FIG. 10 represents a case where the entirety of the spot formed by the beam L of laser light passes through the light reception surface 6*a* of the BD sensor 6. Part (b) of FIG. 10 represents a case where the entirety of the spot which beam L of laser light forms passes outside the light reception surface 6*a* of the BD sensor 6.

As described above, this example of optical scanning apparatus is structured so that the centerline C of the light reception surface 6*a* of the BD sensor 6 in terms of the arrow mark E direction is offset from the centerline Ls of the scanning line L2 in the arrow mark E direction. Further, it is structured so that by no matter which of multiple reflective surfaces 11*a*-11*d* the beam L of laser light is reflected, only a part of the beam L of laser light passes through the light reception surface 6*a* of the BD sensor 6.

By the way, regarding FIGS. 4-6, the referential line CLs (preset referential line for scanning line L2) in terms of the arrow mark E direction coincides with the origin of the coordinate axes. Further, the direction indicated by the arrow mark +E in FIGS. 4-6 is "+ direction" of the coordinate axes, whereas the direction indicated by an arrow mark −E in FIGS. 4-6 is "− direction" of the coordinate axes. The centerline C of the light reception surface 6*a* of the BD sensor 6 is such a straight line that coincides with the center between the top and bottom tips Bt and Bb, and is parallel to the arrow mark D direction. On the other hand, the centerline Ls of the scanning line L2 is such a straight line that coincides with the center between the top and bottom St and Sb of the spot, in terms of the arrow mark E direction, which the beam L of laser light forms, and is parallel to the arrow mark D direction.

Further, the beam L of laser light is represented by such an oval that is symmetrical with reference to its centerline Ls in terms of the arrow mark E direction. Further, the light reception surface 6*a* of the BD sensor 6 is represented by such a rectangle that is symmetrical with reference to the centerline C in terms of the arrow mark E direction.

Each of the reflective surfaces 11*a*-11*d* of the polygon mirror 4 is more or less unparallel to the rotational axis of the polygon mirror 4, because of fabrication tolerance. Therefore, the reflective surfaces 11*a*-11*d* are different in the size of the light reception area M, which equals the size of the portion of the scanning line L2, which overlaps with light reception surface 6*a*, as shown by hatching in FIGS. 4-6. Therefore, the position of the scanning line L2 in terms of the arrow mark E direction (secondary scanning direction) can be determined by detecting the size of the light reception area M. Further, since the reflective surfaces 11*a*-11*d* are different in the size of light reception area M, it is possible to determine which one is reflecting the beam L of laser light at a given point in time. If it is possible to determine the direction in which the scanning line L2 is offset in terms of the secondary scanning direction, amount of offset, and the reflection surface which is currently reflecting the scanning line L2, it is possible to prevent the problem that the image forming apparatus 101 outputs an image which is nonuniform in density in terms of the direction which corresponds to the secondary scanning direction, on the peripheral surface of the photosensitive drum 8, by electrically adjusting the beam L of laser light as it is emitted from the semiconductor laser 1. This method of adjustment will be described later.

By the way, there are cases where even if the optical scanning apparatus 100 is structured so that the referential line CLs is offset in advance from the centerline C of the light reception surface 6*a* in terms of the secondary scanning direction, it is impossible to determine whether the scanning line L2 is offset in the +E direction or −E direction relative to the referential line CLs. FIG. 11 shows the positional relation ship between BD sensor 6 and scanning line L2 (beam L of laser light), of an optical scanning apparatus structured so that its referential line CLs is offset relative to the centerline C of the light reception surface 6*a* in the +E direction. A pattern A represents a case in which the beam L of laser light is offset from the referential line CLs in the +E direction by a width a. A pattern B represents a case in which the beam L of laser light is offset from the referential line CLs in the −E direction by a width b. Patterns A and B are the same in the size of the light reception area M, making it impossible to determine whether the scanning line L2 is offset in the +E direction or −E direction from the referential line CLs.

However, the range in which the amount of offset of the scanning line L2 in the secondary scanning direction caused by each of reflective surfaces 11*a*-11*d* has been roughly known during the manufacturing of the optical scanning apparatus. Therefore, the positional relationship between the scanning lines L2 which correspond to the reflective surfaces 11*a*-11*d*, and the centerline C of the light reception surface 6*a* is set so that even if "surface tilt" or the like causes the scanning line L2 to be offset from the referential line CLs in the secondary scanning direction, the centerline Ls of the scanning line L2 will be on the side of the centerline C of the BD sensor 6 as the referential line CLs. By structuring the optical scanning apparatus 100 as described above, it is possible to eliminate the occurrence of such a situation that it is impossible to determine whether the scanning line L2 is offset in the +E direction, or −E direction.

Further, in a situation in which the entirety of the beam L of laser light is within the light reception surface 6*a*, if the amount by which the beam L of laser light is offset is very small, it is possible that the entirety of the beam L of laser light will be still in the light reception surface 6*a*. In such a case, the output of the BD sensor 6 does not change, making it impossible to detect the amount of offset of the scanning line L2. In the case represented by part (b) of FIG. 10, the beam L of laser light is not caught by the light reception surface 6*a*. Therefore, there is no way at all to detect the amount of the offset of the scanning line L2.

Therefore, if it is desired to determine the direction and amount of the offset of the scanning line L2, based on the output of the BD sensor 6, the positional relationship between the scanning line L2 and BD sensor 6 in terms of the secondary scanning direction has to satisfy certain conditions, which will be described next.

First, it is unavoidable that during the manufacturing of an optical scanning apparatus, the BD sensor 6 is slightly mispositioned (fabrication tolerance), and also, the scanning line L2 is made to offset by the "surface tilt". Therefore, if it is desired to set the positional relationship between the BD sensor 6 and scanning line L2 as it is preset, these errors (fabrication tolerances) have to be taken into consideration.

By the way, the light reception surface 6*a* of the BD sensor 6 has a width a, which is the distance between the tip Bt in terms of +E direction, with reference to the centerline Ls of the scanning line L2, and the tip Bb in terms of −E direction.

On the other hand, the beam L of laser light has a width A, which equals the distance between the tip St in the arrow mark +E direction with reference to the centerline Ls of the scanning line L2, and the tip Sb in the arrow mark −E direction. The optical scanning apparatus 100 does not have a BD lens for focusing the beam L of laser light on the light reception surface 6*a* of the BD sensor 6. Therefore, the width A of the beam L of laser light is the same as the width a of the light reception surface 6*a* of the BD sensor 6.

Because of the "surface tilt" of the polygon mirror 4 and misaiming of the beam L, the centerline Ls of the scanning line L2 is offset from the referential line CLs in the +E direction by as much as a width H, or in the −E direction by as much as a width h. That is, the centerline Ls of the scanning line L2 is offset by as much as width 2*h*. As for the centerline C of the light reception surface 6*a* of BD sensor 6, because of nonuniformity in the position to which BD sensor 6 was attached, positional deviation relative to the referential line CLs occurs to the centerline C of the light reception surface 6*a* of the BD sensor 6 in +E direction by as much as a width e, or in −E direction as much as a width e, that is, a total deviation of 2*e*.

In consideration of the positional deviation widths h and e, the distance H (FIG. 5) between the centerline C and referential line CLs has to satisfy the following mathematical formula (1).

$$-H \leq -e-h \quad (1)$$

As long as H satisfies this formula, even if the scanning line L2 is offset in −E direction by a width e, or the maximum width, the centerline Ls is on the +E direction side of the centerline C of the BD sensor 6.

Further, the optical scanning apparatus 100 has to be structured so that when the scanning line L2 is most deviated in position in the arrow −E direction in FIG. 5, the entirely of the beam L of laser light falls within the light reception surface 6*a* of the BD sensor 6.

In order for this requirement to be satisfied, the optical scanning apparatus 100 has to be structured so that even when the scanning line L2 is offset in −E direction by the maximum width, a part of the beam L of laser light passes on the outward side of the light reception surface 6*a* of the BD sensor 6. More concretely, it has to be structured so that even if the scanning line L2 is offset in −E direction by a width e, or the maximum amount of offset, the tip St of the beam L of laser light will be on the arrow mark +E direction side of the top tip Bt of the light reception surface 6*a* of the BD sensor 6.

In order to do so, the following mathematical formula (2) has to be satisfied.

$$(A/2)-h>(a/2)-H \quad (2)$$

Referring to FIG. 5, the left side of the above mathematical formula, or "(A/2)−h)", shows the position in which the tip St is when the beam L of laser light is offset in −E direction by the maximum amount from the referential line CLs.

On the other hand, the right side, or "(a/2)−H", shows the position in which the top tip Bt of the light reception surface 6*a* of the BD sensor 6 is when the BD sensor 6 is offset in position in +E direction by the largest amount relative to the referential line centerline CLs, as shown in FIG. 5.

That is, the above mathematical formula 2 shows that the top tip St of the beam L of laser light is on the outward side of the top tip Bt of the light reception surface 6*a* of the BD sensor 6, as shown in FIG. 6.

Next, referring to FIG. 6, a case in which the centerline Ls of the scanning line L2 is offset from the referential line CLs in +E direction by the maximum width h is taken into consideration. In this case, an occurrence of such a situation that the entirety of the beam L of laser light moves on the outward side of the light reception surface 6*a* of the BD sensor 6 as shown in part (b) of FIG. 10 has to be avoided.

In order to solve this problem, the optical scanning apparatus 100 has to be structured so that a part of the beam L of laser light moves across the light reception surface 6*a* of the BD sensor 6 as shown in FIG. 6. More concretely, the apparatus 100 has to be structured so that the tip Sb of the beam L of laser light is on the −E direction side of the top tip Bt of the BD sensor 6. Thus, the apparatus 100 has to structured so that the following mathematical formula (3) is satisfied.

$$-(A/2)+h<(a/2)-H \quad (3)$$

The left side of the mathematical formula 3, that is, "−(A/2)+h", shows the position of the tip Sb when the beam L of laser light is most offset from the referential line CLs in −E direction.

On the other hand, the right side of the above mathematical formula 3, that is, "(a/2)−H", shows the position of the top edge Bt of the light reception surface 6*a* when the BD sensor 6 was attached most offset in −E direction from the referential line CLs, as shown in FIG. 6.

That is, the above mathematical formula 3 shows that the top Sb of the beam L of laser light is on the light reception surface 6*a* of the BD sensor 6.

The BD sensor 6 is attached to the position which satisfies both the above mathematical formulas 2 and 3. Thus, only a part of the scanning line L2 passes through the light reception surface 6*a* of the BD sensor 6 regardless by which of the reflective surfaces 11*a*-11*d* the beam L of laser light is deflected.

By the way, this embodiment is one of the examples in which the BD sensor 6 is positioned so that its light reception surface 6*a* is offset from the referential line CLs in −E direction as shown by a solid line in FIG. 4. However, the BD sensor 6 may be positioned so that its light reception surface 6*a* is offset from the referential line CLs in +E direction as shown by a broken line in FIG. 4.

In this embodiment, the width A of the beam L of laser light is 3.0 mm. The width a of the light reception surface 6*a* of the BD sensor 6 is 2.5 mm. Further, the maximum width ±h of positional deviation of the scanning line L2 is ±0.08 mm.

The maximum width ±e of the BD sensor 6 is ±1.0 mm. The amount of offsetting of the centerline C of the BD sensor 6 from referential line CLs has to be set with the use of the above mathematical formula 1, so that the following mathematical formula (4) is satisfied.

$$-H \leq e-h=-1.0-0.08=-1.08$$

$$-H \leq -1.08 \text{ mm} \quad (4)$$

In this embodiment, the value for the width of eccentricity "−H" was set to −1.1 mm, which satisfies the above mathematical equation 4. Application of these conditions satisfies the above mathematical formula 2 as expressed in the following mathematical formula (5).

$$(A/2)-h>(a/2)-H$$

$$(3/2)-0.08>(2.5/2)-1.1$$

$$1.42>0.15 \quad (5)$$

Moreover, the application of these conditions to the above mathematical formula 3 satisfies the relationship expressed in the form of the above mathematical formula as expressed by the following mathematical formula (6).

$$-(A/2)+h<(a/2)-H$$

$$-(3/2)-0.08<(2.5/2)-1.1$$

$$-1.42<0.15 \quad (6)$$

Because of the "surface tilt" of the polygon mirror 4, misaiming of the beam L of laser light, and mispositioning of the BD sensor 6 cause the scanning line L2, and the light reception surface 6*a* of the BD sensor 6, to deviate in position in the arrow mark E direction. However, by designing the optical scanning apparatus 100 so that the above mathematical formulas are satisfied, it is possible to make the optical scanning apparatus 100 change in the size of the light reception area M according to the position of the scanning line L2 in terms of the arrow mark E direction.

Next, referring to FIGS. 7 and 8, the positional relationship between the scanning lines LA−LD of the beam L of laser light, which corresponds to the reflective surfaces 11*a*-11*d*, respectively, of the polygon mirror 4 in this embodiment, and the BD sensor 6, is described. Part (a) of FIGS. 7, 7(*b*) and 8 are drawings for describing the positional relationship between the scanning lines LA–LD of the beam L of laser light, which correspond to the reflective surfaces 11*a*-11*d*, respectively, of the polygon mirror 4 of the optical scanning apparatus 100, and the BD sensor 6, in this embodiment.

Generally speaking, the reflective surfaces 11*a*-11*d* of the polygon mirror 4 suffer from the "surface tilt", which is attributable to the level of accuracy at which the polygon mirror 4 is manufactured, level of accuracy at which the polygon mirror 4 is attached to the deflecting device 5. Therefore, the reflective surfaces 11*a*-11*d* are different in the position of the scanning line L2 (LA–LD shown in FIGS. 7 and 8) in terms of the arrow mark E direction.

Referring to part (a) of FIG. 7, the centerline La of the scanning line LA, and the centerline Lb of the scanning line LB are not offset from the referential line Centerline Ls. Next, referring to part (b) of FIG. 7, the centerline Lc of the scanning line LC in terms of the arrow mark E direction is offset from the referential line CLs in +E direction by a width of hc. Next, referring to FIG. 8, the centerline Ld of the scanning line LD is offset from the referential line CLs in –E direction by a width –hd.

<Method for Detecting Scanning Line Position in Arrow Mark E Direction>

Next, referring to FIG. 9, the method for detecting the position of the scanning line L2 in the arrow mark E direction is described. Part (a) of FIGS. 9 and 9(*b*) are drawings for describing the amount of light reception by the BD sensor 6, and the magnitude of the BD signals. Part (a) of FIG. 9 is a drawing for describing the BD signal which the BD sensor 6 outputs when the centerline CLs of the scanning line L2 coincides with the referential line CLs, as shown in FIG. 4.

A referential code Ps in part (a) of FIG. 9 stands for the amount of light reception at the scanning line L2. In this case, if the amount Ps of light detected by the BD sensor 6 exceeds an amount Pth, that is, the threshold value, the BD sensor 6 generates a BD signal which is "Low" in potential level. The BD signals which the BD sensor 6 outputs as the beam L of laser light moves (scans) along the scanning line L2 is such signals that are ON (Low in potential level) and have a duration (pulse width) Ts.

The amount Ps of light reception in part (a) of FIG. 9 is an example of information regarding referential amount of light reception when the centerline Ls of the scanning line L2 coincides with the referential line CLs.

part (b) of FIG. 9 shows the BD signals, which correspond to the scanning lines LA–LD shown in part (a) of FIGS. 7, 7(*b*) and 8. Referential codes Pa and Pb in part (b) of FIG. 9 stand for the amounts of light reception, which correspond to the scanning lines LA and LB, respectively. Further, referential codes Ta and Tb stand for the pulse widths of the BD signals outputted by the BD sensor 6.

Referring to part (b) of FIG. 7, the portion of the light reception surface 6*a* of the BD sensor 6, which overlaps with the scanning line LC is referred to as the light reception area of the light reception surface 6*a*, and a referential code Mc stands for the this portion of the light reception surface 6*a*. The area Mc is smaller than the light reception areas Ma and Mb of the light reception surface 6*a*, which overlap with the scanning lines LA and LB, respectively, shown in part (a) of FIG. 7.

Therefore, the amount Pc of the light reception by the light reception surface 6*a*, which corresponds to the scanning line LC, is smaller than the amounts Pa and Pb of the light reception by the light reception surface 6*a*, which correspond to the scanning lines LA and LB, respectively, as shown in part (b) of FIG. 9. The duration Tc of the BD signal, which corresponds to the amount Pc of light reception is shorter than the durations Ta and Tb of the BD signal, which correspond to the amounts Pa and Pb of light reception, respectively.

Further, referring to FIG. 8, a referential code Md stands for the portion of the light reception surface 6*a* of the BD sensor 6, which overlaps with the scanning line LD. This area Md is greater than the areas Ma and Mb of light reception.

Therefore, an amount Pd of light reception by the light reception surface 6*a*, which corresponds to the scanning line LD is greater than the amounts Pa and Pb of light reception by the light reception surface 6*a*, which correspond to the scanning lines LA and LB, respectively, as shown in part (b) of FIG. 9.

Therefore, the duration Td, which corresponds to the amount Pd of light reception, is longer than the durations Ta and Tb, which correspond to the amounts Pa and Pb of light reception, respectively. Therefore, the relationship among the durations Ta–Td satisfies the following mathematical formula (7).

$$Tc<Ta=Tb<Td \tag{7}$$

That is, the durations Ta, Tb, Tc and Td (pulse widths) of the BD signal which the BD sensor 6 outputs corresponds to the sizes of the areas Ma, Mb, Mc and Md of light reception. Thus, the widths hc–hd of positional deviation of the scanning lines LA–LD from the referential line CLs can be determined based on the durations Ta–Td. That is, the position of each of the scanning lines LA–LD in terms of the arrow mark E can be determined.

The timing, with which the BD signal, which functions as the reference for the point at which an image begins to be written, is obtained based on the central value TB of each of the durations Ta–Td shown in part (b) of FIG. 9. The central value TB of each of the durations Ta–Td remains stable. Therefore, even if the scanning lines LA–LD are different in position in terms of the arrow mark E direction in FIGS. 7 and 8, they remain stable in the central value TB. Therefore, the image forming apparatus 101 remains stable in the BD signal generation timing. Therefore, it does not output such a defective image that its defect is attributable to the positional instability of the scanning lines LA–LD in terms of the arrow mark E direction in FIGS. 7 and 8.

Figure 3:
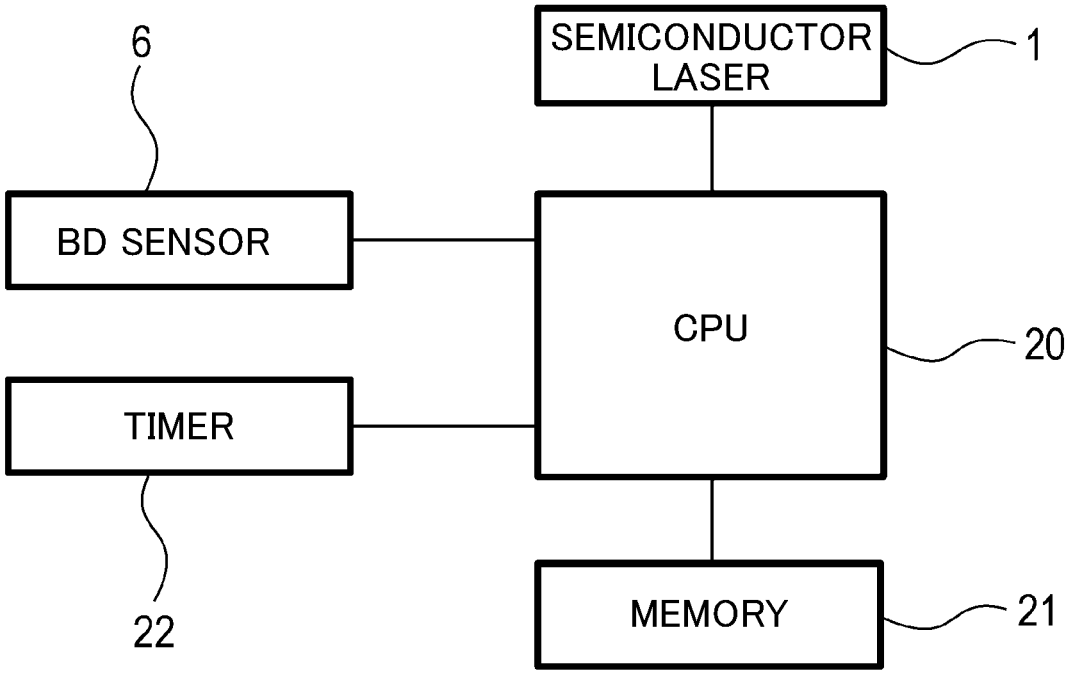
FIG. 3 is a block diagram of the control portion; it shows the structure of the control portion.

Referring to FIG. 3, the image forming apparatus 101 is provided with a CPU 20 as a controlling portion, and a memory 21 as a storing portion. The CPU 20 determines the position of the beam L of laser light in terms of the arrow mark E direction, based on the durations Ta–Td. In the memory 20, a referential duration Ts, which corresponds to a case where the scanning line L2 coincides with the referential line CLs, is stored in advance. The CPU 20 is in connection to the semiconductor laser 1 and BD sensor 6. The information regarding the duration T, that is, the pulse width of the BD signal which the BD sensor 6 outputs, is sent to the CPU 20.

The CPU 20 determines the width h of the positional deviation of each scanning line, by comparing the durations Ta–Td with the referential duration Ts.

The durations Ta–Td can be calculated based on the points in time at which the amounts Pa–Pd of light reception reached a preset amount Pth (threshold value) of light reception, and points ta2, tb2, tc2 and td2 in time at which the amounts Pa–Pd of light reception fell below a preset amount Pth.

The data table which shows the relationship between the durations Ta–Td, and widths hc–hd of positional deviation of the scanning lines LA–LD from the referential line CLs is stored in the memory 21.

In this embodiment, the amounts Pa–Pd of light reception were used as the information regarding the amount of the beam L of laser light detected by the light reception surface 6*a* of the BD sensor 6.

However, the size of each of area Ma–Md may be used instead of the amount of light reception.

In such a case, a data table which shows the relationship between the size of each of the areas Ma–Md, and each of the widths hc–hd, respectively, of the positional deviation from the referential line Centerline Ls is created, and is stored in the memory 21. The light reception surface 6*a* comprises multiple photoelectric transducer cells which are arranged in matrix. It can convert the number of the photoelectric transducer cells turned ON by the reception of beam L of laser light, into the size of each of the areas Ma–Md. The CPU 20 can determine the amount of positional deviation of each of the scanning lines LA–LD from the referential line CLs, based on the size of each of the areas Ma–Md of the light reception surface 6*a* of the BD sensor 6, with reference to the data table stored in the memory 21. If the positional deviation widths hc~hd of the scanning lines LA–LD, respectively, can be determined, the interval among the scanning lines LA–LD (scanning line interval) in the secondary scanning direction can be determined.

The CPU 20 adjusts the beam L of laser light in amount by controlling the semiconductor laser 1, based on the information regarding the position of the scanning lines LA–LD in terms of the secondary scanning direction (or information regarding scanning line interval). The memory 21 stores the table for adjusting the optical scanning apparatus 100 in the relationship between the scanning line interval, and amount of beam L of laser light.

More concretely, if the CPU 20 determines that the optical scanning apparatus 100 is denser in scanning line interval than the normal one, it reduces the optical scanning apparatus 100 in the amount of the beam L of laser light, based on the adjustment table stored in the memory 21. On the other hand, if it is determines that the optical scanning apparatus 100 is coarser in scanning line interval than the normal one, it increases the optical scanning apparatus 100 in the amount of beam L of laser light.

Thus, it is possible to prevent the image forming apparatus 101 from reducing in image quality due to the banding (undulant nonuniformity in density).

As for the adjustment of the optical scanning apparatus 100 in the amount by which the beam L of laser light is outputted by the semiconductor laser 1, it is done when the image forming apparatus 101 is used for the first time. The optical scanning apparatus 100 for color image formation suffers from a phenomenon that its gradually changes in the position of its beam L of laser light in terms of the arrow mark E direction, with the elapse of time. In such a case, the position of the beam L of laser light in terms of the arrow mark E may be continuously detected.

By the way, all that is necessary is to control the optical scanning apparatus 100 in at least one of the amount of the beam L of laser light, which corresponds to the area which is narrow in the interval of the scanning line L2 in terms of the secondary scanning direction, and the amount of the beam L of laser light, which corresponds to the area which is wider in the interval of the scanning line L2, so that the former becomes less than the latter.

In this embodiment, in order to prevent the image forming apparatus 101 from reducing in image quality due to the banding in terms of the arrow mark E direction, the optical scanning apparatus 100 was adjusted in the amount of beam L of laser light. However, a method other than the one used in this embodiment may be used to reduce the image forming apparatus 101 in the amount by which the apparatus reduces in image quality due to banding.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2019-066221 filed on Mar. 29, 2019 and 2020-032975 filed on Feb. 28, 2020, which are hereby incorporated by reference herein in their entirety.

What is claimed is:

1. An image forming apparatus for forming an image in accordance with image information on a recording material, said apparatus comprising:

a photosensitive member;

a scanner unit configured to scan said photosensitive member with a laser beam in accordance with the image information, said scanner unit including a light source configured to emit the laser beam, a deflector having a rotatable polygonal mirror configured to reflect the laser beam to deflect the laser beam, and a sensor configured to receive the laser beam deflected by said deflector;

a controller configured to control scanning start timing of the laser beam in response to an output of said sensor, wherein a reference position of scanning lines of the laser beam in a sub-scan direction and a center position of a receipt surface of said sensor in the sub-scan direction are deviated from each other, wherein for all of the scanning lines by reflecting surfaces of said rotatable polygonal mirror, only parts, in the sub-scan direction, of the scanning lines pass said receipt surface of said sensor, and wherein said receipt surface of said sensor includes a region where the scanning lines do not pass in the sub-scan direction.

2. An apparatus according to claim 1, wherein a positional relation between the scanning lines and the center position is such that even when the scanning lines are deviated from the reference position in the sub-scan direction, a center of the scanning line in the sub-scan direction is in a side where the reference position is placed, with respect to the center position of said sensor.

3. An apparatus according to claim 1, wherein said controller detects the position of the scanning line in the sub-scan direction in accordance with a received light quantity when said receipt surface receives the laser beam.

4. An apparatus according to claim 1, wherein said controller detects the position of the scanning line in the sub-scan direction in accordance with a light receipt area when the receipt surface receives the laser beam.

5. An apparatus according to claim 1, wherein said controller controls a light intensity of said light source in accordance with the position of the scanning line in the sub-scan direction.

6. An apparatus according to claim 1, wherein said controller controls a light intensity of said light source in accordance with an interval between the scanning lines in the sub-scan direction.

7. An apparatus according to claim 6, wherein said controller controls at least one of the laser beam corresponding to an area where intervals between the scanning lines in the sub-scan direction are relatively small and a laser beam corresponding to an area where the intervals between the scanning lines in the sub-scan direction are relatively large, such that a former laser beam has an intensity lower than that of a latter laser beam.

8. A scanner unit for scanning a photosensitive member with a laser beam in accordance with image information, said scanner unit comprising:

a light source configured to emit the laser beam;

a deflector including a rotatable polygonal mirror configured to reflect the laser beam to deflect the laser beam; and a sensor configured to receive the laser beam deflected by said deflector to control scanning start timing of said laser beam, wherein a reference position of scanning lines of the laser beam in a sub-scan direction and a center position of a receipt surface of said sensor in the sub-scan direction are deviated from each other, wherein for all of the scanning lines by reflecting surfaces of said rotatable polygonal mirror, only parts, in the sub-scan direction, of the scanning lines pass said receipt surface of said sensor, and wherein said receipt surface of said sensor includes a region where the scanning lines do not pass in the sub-scan direction.

9. An image forming apparatus for forming an image in accordance with image information on a recording material, said apparatus comprising:

a photosensitive member;

a scanner unit configured to scan said photosensitive member with a laser beam in accordance with the image information, said scanner unit including a light source configured to emit the laser beam, a deflector having a rotatable polygonal mirror configured to reflect the laser beam to deflect the laser beam, and a sensor configured to receive the laser beam deflected by said deflector;

a controller configured to control scanning start timing of the laser beam in response to an output of said sensor, wherein a reference position of scanning lines of the laser beam in a sub-scan direction and a center position of a receipt surface of said sensor in the sub-scan direction are deviated from each other, wherein for all of the scanning lines by reflecting surfaces of said rotatable polygonal mirror, only parts, in the sub-scan direction, of the scanning lines pass said receipt surface of said sensor, and wherein said controller detects the position of the scanning line in the sub-scan direction in accordance with a received light quantity when said receipt surface receives the laser beam.

* * * * *